United States Patent [19]

Hubbert

[11] Patent Number: 4,733,481

[45] Date of Patent: Mar. 29, 1988

[54] PAINT BAKE OVEN

[75] Inventor: Gordon F. Hubbert, Plymouth, Mich.

[73] Assignee: Gladd Industries, Inc., Detroit, Mich.

[21] Appl. No.: 844,112

[22] Filed: May 19, 1986

Related U.S. Application Data

[60] Division of Ser. No. 570,071, Jan. 9, 1984, Pat. No. 4,635,381, which is a continuation-in-part of Ser. No. 393,274, Jun. 29, 1982, abandoned.

[51] Int. Cl.[4] ..... F26B 23/10

[52] U.S. Cl. ..... 34/243 C; 34/39; 432/147

[58] Field of Search ..... 34/4, 39, 243 C, 225, 34/233; 432/72, 128, 133, 136, 144, 145, 146, 147, 148, 149, 150, 152, 155, 163, 164, 168, 169, 170, 171, 176, 188, 192, 199, 209

[56] References Cited

U.S. PATENT DOCUMENTS

| | | | |
|---|---|---|---|
| 842,538 | 1/1907 | Elward | 34/232 |
| 1,276,979 | 8/1918 | Sidman | 34/39 |
| 1,615,593 | 1/1927 | Manker | 432/209 |
| 1,744,817 | 1/1930 | Ward | 34/224 |
| 2,141,403 | 12/1938 | Offen | 34/54 |
| 2,166,294 | 7/1939 | Hetzer | 34/54 |
| 2,295,475 | 9/1942 | Hurythal | 34/225 |
| 2,663,951 | 12/1953 | Kennison | 34/233 |
| 2,968,894 | 1/1961 | Hess | 432/147 |
| 3,130,961 | 4/1964 | Verner et al. | 432/145 |
| 3,668,817 | 6/1972 | Bell | 34/225 |
| 3,720,003 | 3/1973 | Huthmann | 34/225 |
| 3,905,127 | 9/1975 | Davis | 432/112 |
| 3,920,382 | 11/1975 | Hovis et al. | 432/209 |
| 3,977,091 | 8/1976 | Hortig et al. | 34/225 |
| 3,997,317 | 12/1976 | Dicks | 432/145 |
| 4,010,341 | 3/1977 | Ishammar | 34/233 |
| 4,039,278 | 8/1977 | Denholm | 34/225 |
| 4,098,567 | 7/1978 | Hubbert | 432/72 |
| 4,136,463 | 1/1979 | Nolan et al. | 34/39 |
| 4,162,141 | 7/1979 | West | 432/145 |
| 4,310,300 | 1/1982 | Mackenzie | 432/148 |
| 4,324,545 | 4/1982 | Hubbert | 432/72 |
| 4,383,823 | 5/1983 | Williams et al. | 432/188 |
| 4,395,832 | 8/1983 | Jones | 34/66 |
| 4,409,743 | 10/1983 | Jesperson | 34/225 |
| 4,416,068 | 11/1983 | Nilsson et al. | 34/39 |
| 4,546,553 | 10/1985 | Best | 34/39 |

*Primary Examiner*—Albert J. Makay
*Assistant Examiner*—David W. Westphal
*Attorney, Agent, or Firm*—Reising, Ethington, Barnard, Perry & Milton

[57] ABSTRACT

An improved paint bake oven (10) of a modular construction is disclosed as including a convection heating module (12), exhaust modules (64), and a radiant drying module (80). The heating module (12) includes outer and inner housings (14) and (16) as well as an upper central supply plenum (20) and a central upper return plenum (28) that cooperate to provide efficient gas flow to painted products being baked upon passage through the heating module. Each exhaust module (64) is connected to an associated heating module so as to receive and exhaust gas therefrom to the environment. The radiant drying module (80) is located upstream from the heating module (12) and includes an outer insulated housing (84), an inner housing (86) having side passages (92) located on opposite sides of a product passage of the drying module (80), and a heater (96) that supplied heated gas to the side passages (92) to provide radiant heating that initially dries the painted products.

1 Claim, 10 Drawing Figures

PAINT BAKE OVEN

RELATED APPLICATION

This is a division, of application Ser. No. 570,071, filed on Jan. 9, 1984 now U.S. Pat. No. 4,635,381, which is a continuation-in-part of copending application Ser. No. 393,274 filed June 29, 1982 now abandoned.

TECHNICAL FIELD

This invention relates to a paint bake oven of the type conventionally used to bake products after painting in order to provide a hard and durable painted coating on the products.

BACKGROUND ART

One type of paint bake oven which is conventionally used to bake painted vehicle bodies includes an elongated housing of a rectangular cross-section to which heated gas is supplied to provide baking of painted vehicle bodies upon conveyance through the housing. This type of oven conventionally includes a pair of gas supply ducts respectively extending along the upper lateral corners of the housing and having outlets for directing the heated gas downwardly against the floor of the housing to provide gas deflection back up toward the conveyed vehicle bodies. A damper conventionally extends between the pair of supply ducts and is adjustable to control the flow of gas upwardly to an outlet duct through which the gas is returned to a heater prior to flow back to the supply ducts in a recirculating fashion.

Vehicle body paint bake ovens of the type described above are conventionally fabricated at the factory site where the oven is to be used and, as such, considerable erection time and costs are normally involved with such ovens. Also, the fabrication of the oven at the factory site often results in gas leaks that reduce the efficiency of the oven and emit contaminated gas to the factory atmosphere. Deflection of the heated gas upwardly from the floor of the oven housing also creates a turbulence that picks up dust and dirt particles which can adhere to the wet paint on the vehicle bodies prior to drying and thereby produce defects when the paint finally dries. To overcome this problem, radiant heaters have been utilized in the oven at its upstream end just downstream from where the vehicle bodies are spray painted. Radiant heating of the vehicle bodies thus initially dries the paint without the use of circulating heated gas that can carry dust or dirt particles to the wet paint.

Further problems arise from the prior art ovens being rectangular. The ovens are made from insulated panels connected at joints and are supported from an I-beam frame. Condensation of paint fumes saturate the panels at the joints. This condition increases heat losses and creates a potential fire hazard.

STATEMENT OF THE INVENTION

The modular paint bake oven of the invention includes a convection heating module having an outer insulated housing. An inner housing of the heating module is received within its outer housing and defines a product passage through which painted products to be baked are passed in any suitable manner such as by conveyance on a floor conveyor or conveyance in a depending relationship on a topside conveyor. An upper central supply plenum of the heating module is located above the inner housing thereof within the outer housing. The inner housing has perforated lateral side walls defining a bifurcated gas flow path from the supply penum to the product passage. A central upper return plenum of the heating module is located above the product passage and below the supply plenum. The inner housing has a perforated top wall through which gas flows from the product passage to the return plenum in order to permit recirculating flow during use.

FIGURES IN THE DRAWINGS

The objects, features, and advantages of the present invention are readily apparent from the following detailed description of the best mode for carrying out the invention when taken in connection with the accompanying drawings, wherein.

DETAILED DESCRIPTION OF THE DRAWINGS

Figure 1:
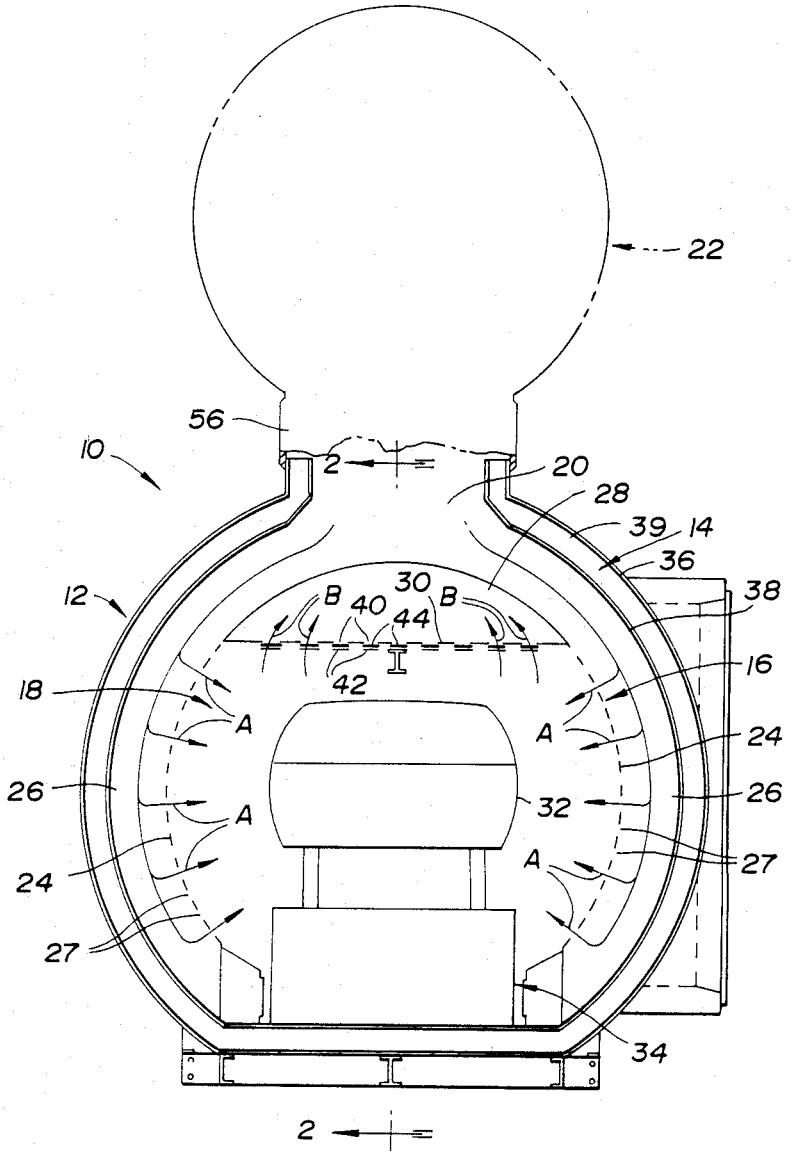
FIG. 1 is a cross-sectional view taken through a heating module of a paint bake oven constructed in accordance with the present invention.
Figure 2:
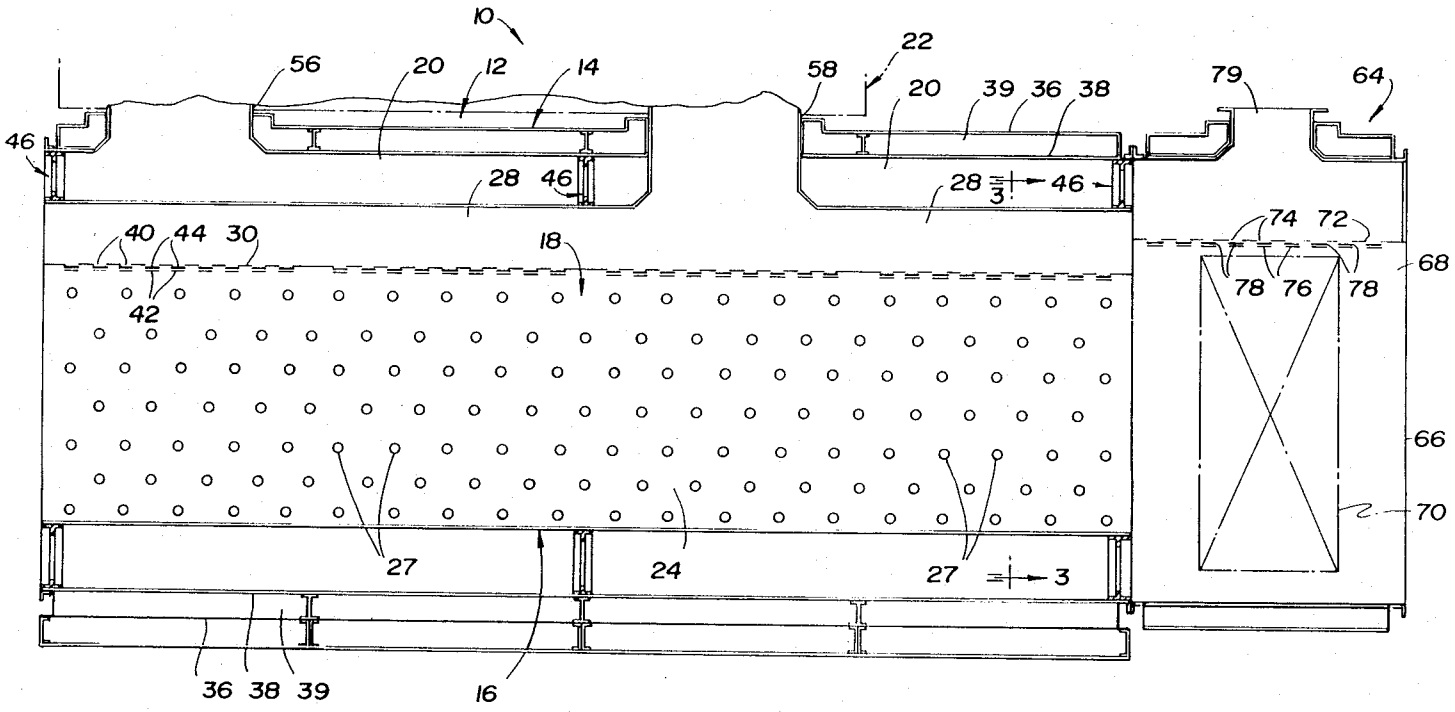
FIG. 2 is a longitudinal sectional view taken along the direction of line 2—2 in FIG. 1 through both the heating module and an associated exhaust module of the oven.

Referring to FIGS. 1 and 2 of the drawings, a paint bake oven 10 in accordance with the present invention has a module construction including a convection heating module 12. An outer insulated housing 14 of heating module 12 has an elongated shape as seen in FIG. 2 along the direction in which products are conveyed through the oven from the left toward the right. Heating module 12 also includes an inner housing 16 received within the outer housing and defining a product passage 18 through which products are passed during baking within the oven. An upper central supply plenum 20 of the heating module 12 is located above the inner housing 16 within the outer housing 14 and receives heated gas from a schematically indicated recirculating heater 22 such as one of the types disclosed by U.S. Pat. Nos. 4,098,567 and 4,324,545. Inner housing 16 of the heating module 12 has perforated lateral side walls 24 defining a bifurcated gas flow path 26 from the central supply plenum 20 to the product passage 18. Gas flows through openings 27 in the side walls 24 upon passing into the product passage 18 as illustrated by arrows A. A central upper return plenum 28 of the heating module is located above the product passage 18 and below the supply plenum 20 within the outer insulated housing 14. Inner housing 16 has a perforated top wall 30 through which gas flows as indicated by arrows B from the product passage 18 to the return plenum 28.

Paint bake oven 10 including the heating module 12 has particular utility when used to bake painted vehicle bodies 32 which are conveyed through the product passage 18 on a suitable conveyor 34. During such conveyance, the heated gas supplied to the product passage 18 bakes the paint on each vehicle body 32 to provide hard and durable painted surface.

As seen by continuing reference to FIG. 1, the outer insulated housing 14 of the heating module 12 has a generally round cross-section and includes outer and inner sheet metal walls 36 and 38 as well as an intermediate layer 39 of a high temperature insulation such as mineral wool. The sidewalls 24 of the inner housing 16 of heating module 12 are made of sheet metal and preferably have curved shapes that provide the product passage 18 with a rounded cross-section. This rounded construction of the heating module 12 provides a relatively compact construction that reduces heat loss to the environment as well as providing a proximal supply of the heated gas flow from the perforated lateral side walls 24 to the conveyed vehicle bodies 32. It will be noted that the gas flow is directed directly toward the vehicle bodies 32 rather than downwardly and then upwardly as is the case with conventional automotive paint bake ovens. Also, the modular construction of the heating module 12 permits prefabrication that reduces erection costs and also insures a sealed condition so that there is no gas leakage to the environment during use. The rounded walls have no seams and do not allow the heat loss of prior art rectangular ovens that have panels connected at joints. The concomittant fire hazard is also alleviated. Further, the round shape provides preferential heat expansion characteristics compared to the prior art construction.

With combined reference to FIGS. 1 and 2, it will be noted that the top wall 30 of the inner housing 16 is made of sheet metal and includes openings 40 that are formed by a suitable punching operation such that the punched portions 42 are located downwardly from the openings. A sheet metal adjusting member of the inner housing includes adjusting portions 44 that are received between the openings 40 and the punched portions 42 to provide adjustment of the size of each opening. Movement of the adjusting member positions the adjusting portions 44 to control the size of the openings 40 in order to thereby control the rate of gas flow through the heating module 12.

Figure 3:
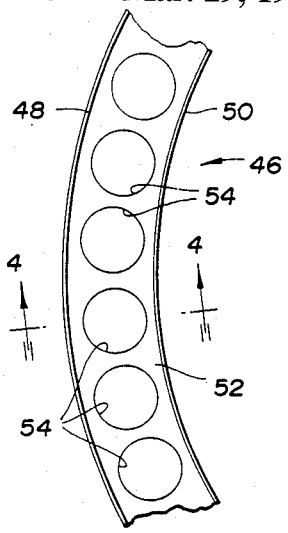
FIG. 3 is a partial view taken along the direction of line 3—3 in FIG. 2 and illustrates supports that mount an inner housing of the heating module within an outer housing thereof in a spaced relationship.
Figure 4:
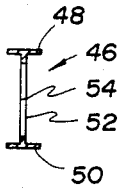
FIG. 4 is a sectional view taken through the support along the direction of line 4—4 in FIG. 3.

With combined reference to FIG. 2, 3 and 4 the inner housing 16 is supported in a spaced relationship to the outer housing 14 by a plurality of longitudinally spaced supports 46. Each support 46 has a curved shape of a generally I beam construction including an outer flange 48 that is secured to the outer housing 14 and an inner flange 50 that is secured to the inner housing 16. A central connecting web 52 of each support 46 extends between its outer and inner flanges 48 and 50 and includes openings 54 reducing through metal heat conductance to the outer wall.

As previously mentioned in connection with FIG. 1, the recirculating heater 22 of the oven 10 is mounted on the outer housing 14 of the heating module 12 above the product passage 18 through which the automotive bodies 32 are conveyed. The round cross-sectional structure provides a self supporting structure upon which the heater 22 is mounted. Rectangular prior art structures could not support the weight of these heaters. As the invention is self supporting, the I-beam frame of the prior art assemblies is no longer required. Hence, the round cross-sectional structure provides several significant improvements over the prior art. A supply duct 56 feeds heated gas from the heater 22 to the supply plenum 20 of the heating module for flow through the bifurcated gas flow path 26 to the products chamber 18 as previously described. After baking the painted automotive body 32, the gas then passes upwardly through the top wall 30 of the product passage 18 into the return plenum 28 as illustrated by arrows B in FIG. 1. A return duct 58 (FIG. 2) connects the return plenum 28 to the recirculating heater 22 so as to return the used gas from the return plenum to the heater for recirculating flow.

Figure 5:
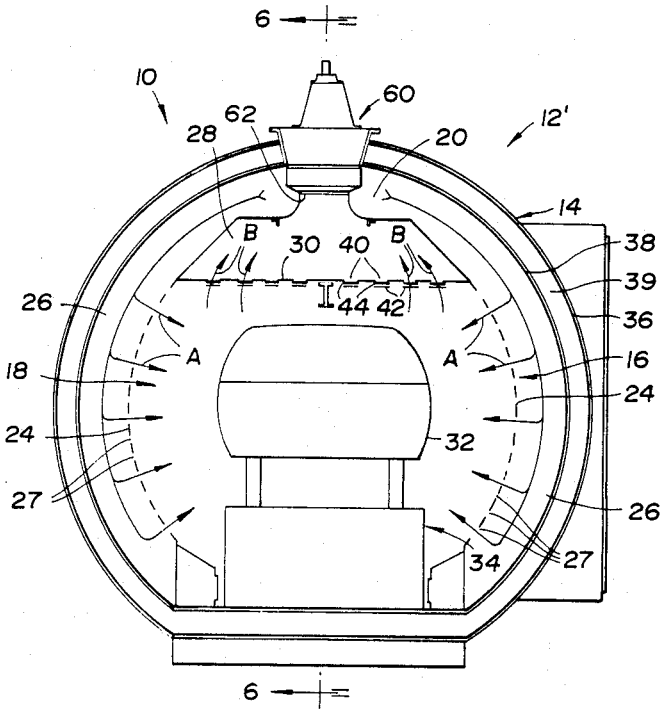
FIG. 5 is a cross-sectional view through another embodiment of the heating module of an oven constructed in accordance with the present invention.
Figure 6:
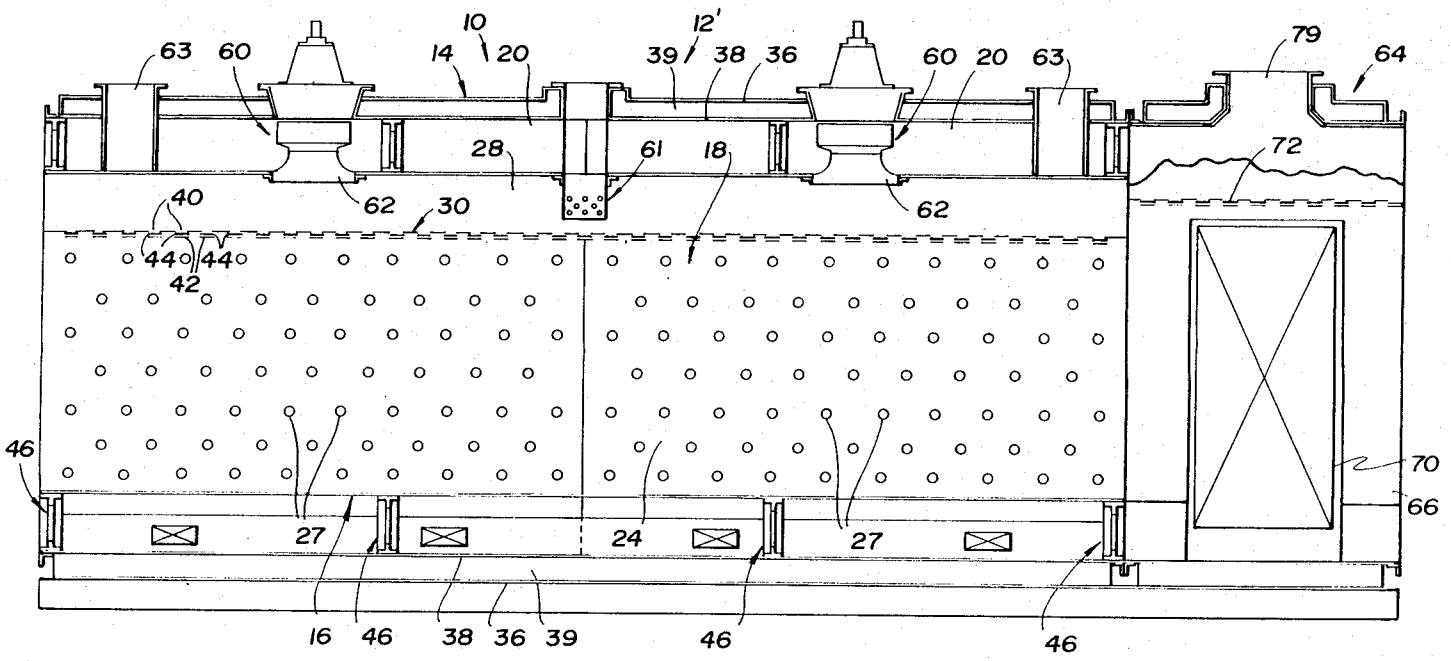
FIG. 6 is a longitudinal sectional view of the heating module taken along the direction of line 6—6 in FIG. 5.

With combined reference to FIGS. 5 and 6, another embodiment of the oven 10 includes a convection heating module 12' which is similar to previously described embodiment except as will be noted. As such, like reference numerals are applied to like components thereof and much of the previous description is applicable such that no repetition thereof is necessary.

As illustrated in both FIGS. 2 and 6, each heating module 12 and 12' of the oven 10 has an associated exhaust module 64 connected thereto so as to receive and exhaust gas from the product passage 18 to the environment. Each exhaust module 64 includes a sheet metal housing 66 that defines a product passage 68 as shown in FIG. 2 aligned with the product passage 18 of the associated heating module. Housing 66 of the exhaust module 64 includes an explosion relief type door 70 that also provides access to the interior of the oven for maintenance. Above the product passage 68, the housing 66 includes a top wall 72 having openings 74 that are formed by punching portions 76 of the wall downwardly. An adjusting member of the top wall includes portions 78 that are movable to control the size of the top wall openings 74. Any type of suitable exhaust fan is mounted on an exhaust duct 79 on top of the exhaust module so as to draw gas upwardly through the openings 74 at a controlled rate in order to permit introduction of fresh air or inert gas to the oven by the recirculating heater 22 of the FIG. 2 embodiments or the fresh air ducts 63 of the FIG. 6 embodiment.

Figure 7:
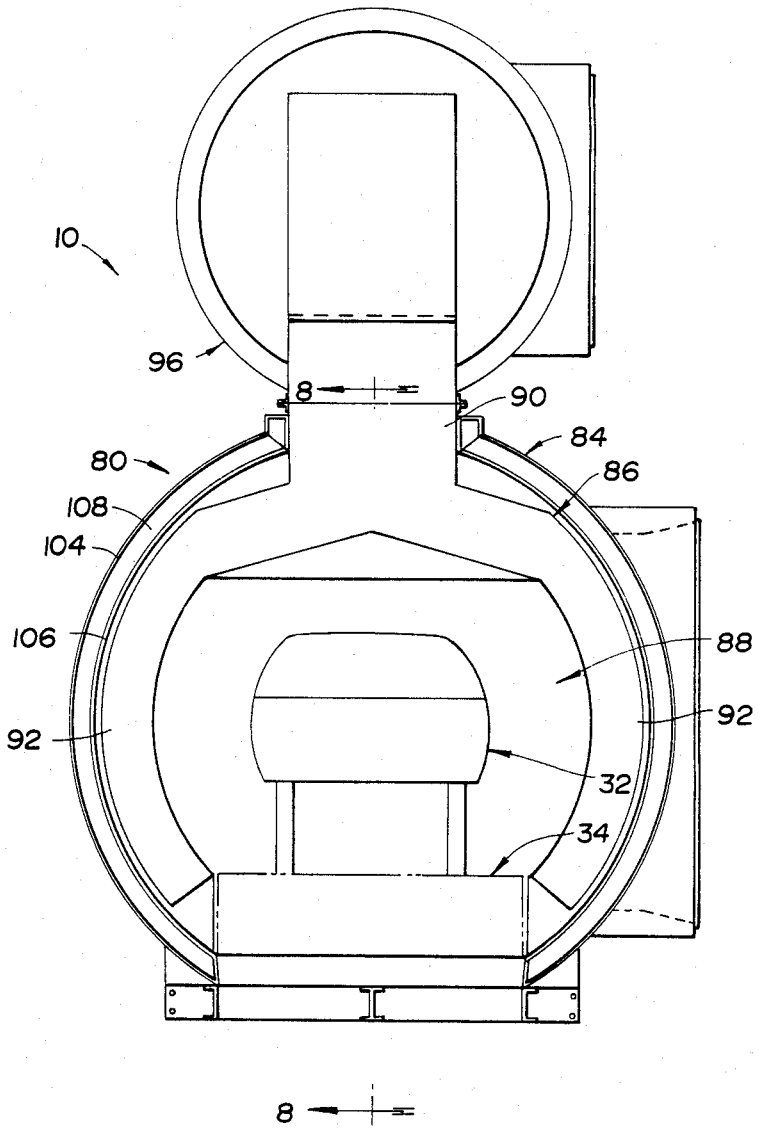
FIG. 7 is a cross-sectional view through a radiant heating module of the paint bake oven constructed in accordance with the invention.
Figure 8:
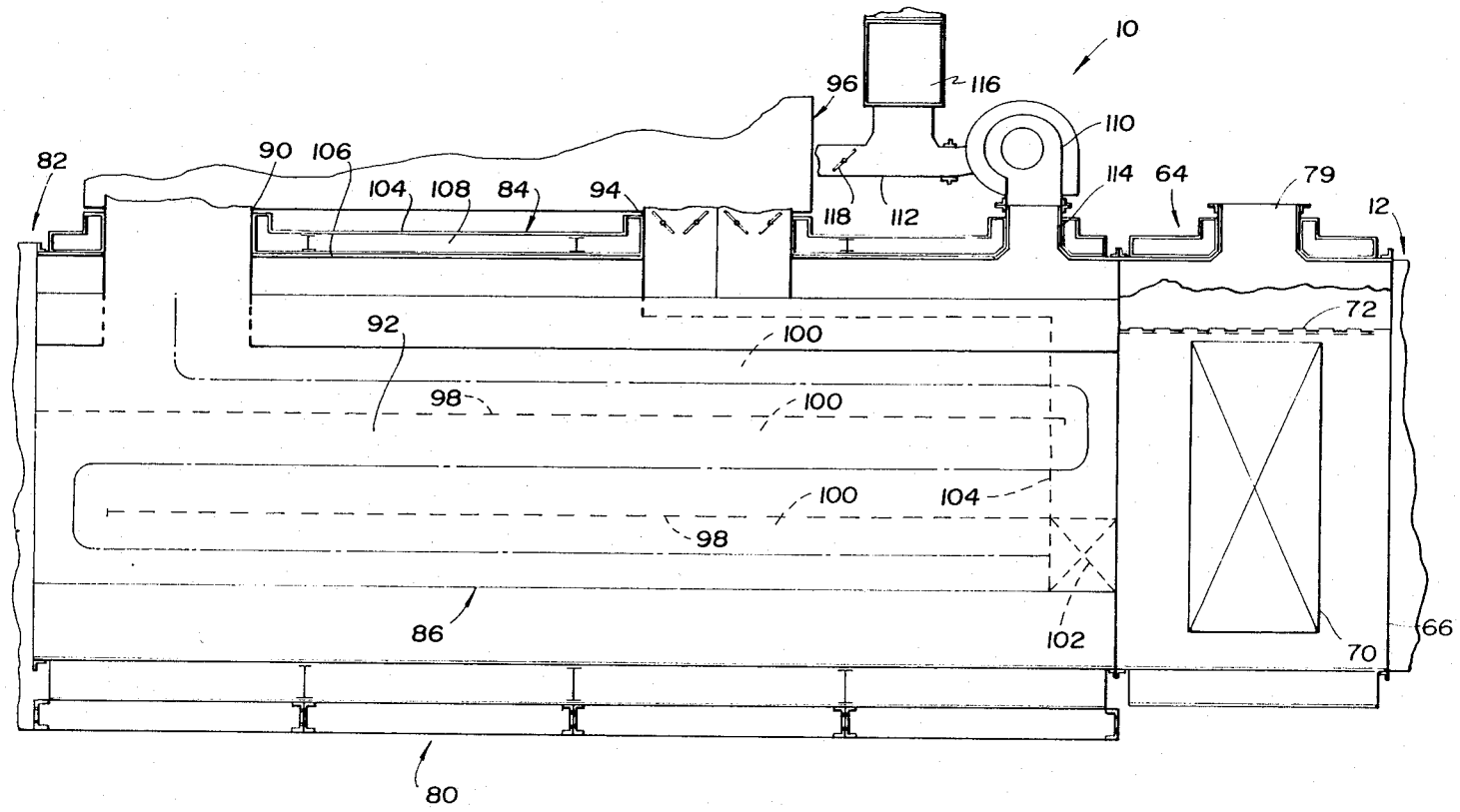
FIG. 8 is a longitudinal sectional view taken along the direction of line 8—8 of FIG. 7 through the heating module and an exhaust module of the oven.

With reference to FIGS. 7 and 8, the paint bake oven 10 also includes a radiant drying module 80 that initially dries the painted products prior to passage through the gas heating module as previously described. As seen in FIG. 8, the radiant drying module 80 is located just downstream from a spray station 82 at which the vehicle bodies are sprayed painted and has an associated exhaust module 64 that is located just upstream from the heating module 12 illustrated. Of course, the radiant drying module 80 can also be utilized with the heating module 12' previously described as a component of the oven 10 and can also be used by itself or with one or more other identical radiant drying modules.

With continuing reference to FIGS. 7 and 8 radiant, drying module 80 includes an outer insulated housing 84 and an inner housing 86 received within the outer housing thereof and defining a product passage 88 through which the conveyor 34 conveys vehicle bodies 32 in the same manner previously described in connection with the heating modules 12 and 12'. Inner housing 86 of the drying module includes a central upper supply duct 90 and a pair of side passages 92 located on opposite sides of product passage 88. A return duct 94 shown in FIG. 8 is communicated with the side passages 92. A heater 96 which is preferably of one of the types disclosed by U.S. Pat. Nos. 4,098,563 and 4,324,545 provides heated gas to the supply duct 90 of the drying module and receives gas from the return duct 94 after passage through the side passages 92 to provide radiant heating of the vehicle body products 32 that pass through the product passage 88 on the conveyor 34.

As illustrated in FIG. 8, each side passage 92 of the inner housing of the radiant drying module 80 includes longitudinal partitions 98 that define a plurality of longitudinal runs 100 through which the heated gas flows parallel to the product passage through which the products are conveyed from radiant heating. The gas initially flows from the supply duct 90 to the upper run 100 for flow toward the left prior to passage to the lower run 100 for flow back toward the right. At the right terminal end of the lower run 100, the gas is received by the lower end 102 of an extension 104 of return duct 94 so as to flow upwardly therethrough back to the heater 96 as previously described.

As illustrated in FIG. 7, the outer housing 86 of drying module 80 has a generally round cross-section and includes outer and inner sheet metal walls 104 and 106 as well as an intermediate layer 108 of a suitable high temperature insulation such as mineral wool. Inner housing 86 of the drying module is fabricated from sheet metal and its side passages 92 preferably have curved shaped so as to provide the product passage 88 with a rounded cross-section. Side passages 92 of the inner housing 86 are also preferably spaced from the outer housing 84 a slight extent so as to thereby lessen heat loss to the environment from the inner housing and thereby provide efficiency in operation. Suitable supports may extend inwardly from the outer housing 84 to the inner housing 86 in order to provide support thereof in the spaced relationship shown.

As illustrated in FIG. 8, a recirculating fan 110 of the drying module 80 receives gas from the return duct 94 through a feeder duct 112 and delivers this gas through a duct 114 to between the outer housing 84 and side passages 92 of the inner housing 86. Feeder duct 112 has a fresh air filter 116 through which fresh air is supplied to the recirculating fan 110 and also has a damper 118 that controls the rate of gas flow through the recirculating fan. Such gas flow prevents the buildup of hot gas between the outer housing 84 and the side passages 92 of the inner housing 86 and thereby decreases the heat flow to the environment through the outer housing 84.

Figure 9:
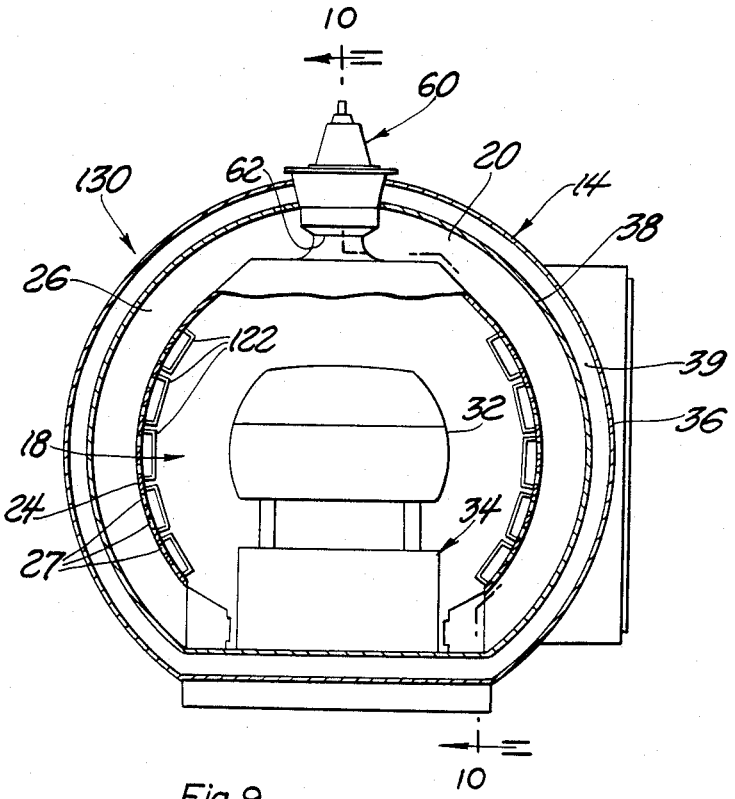
FIG. 9 is a cross-sectional view through another embodiment of the present invention.
Figure 10:
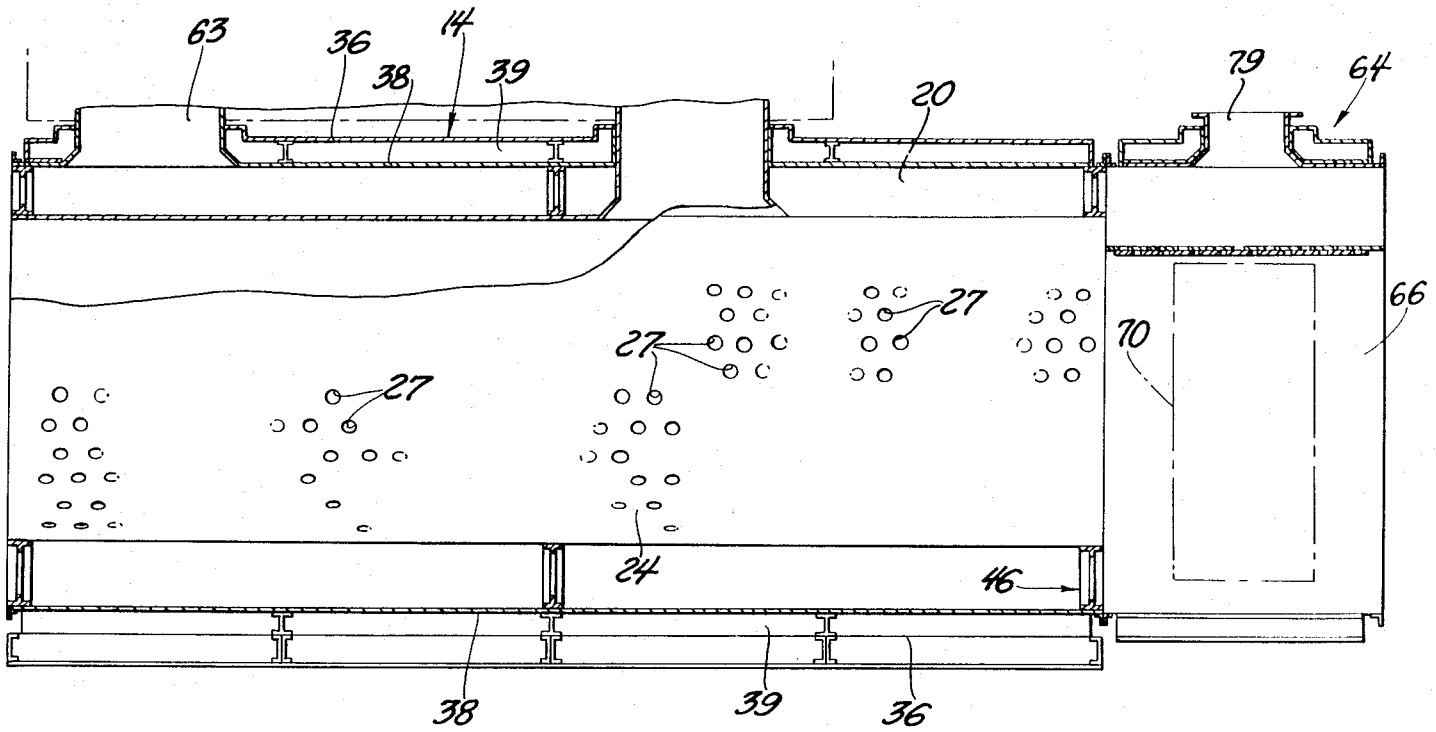
FIG. 10 is a longitudinal sectional view taken substantially along line 10—10 of FIG. 9.

Another embodiment of the present invention is shown in FIGS. 9 and 10. The paint bake oven shown is similar in construction to the oven shown in FIG. 5 and like numerals designate like structures. This embodiment of the invention includes gas flow control means for covering at least a portion of the perforated side walls 24 to direct the flow of gas into selected portions of the inner passageway 18. The gas flow control means includes a plurality of removable baffles 122 covering at least some of the perforations or openings 27.

As shown in FIG. 9, the removable baffles 122 may cover all the openings 27 so that the oven is effectively a radiant type oven. In this form, the heat from the gases flowing in the gas flow path 26 radiate through the side walls 24 and removable covers 122 into the product passageway 18. Alternatively, as shown in FIG. 10, the removable covers 122 may be used to cover selected portions of the perforations 27 in various portions of the module so as to direct heat by convection to portions of the product passing through the product passageway and to direct heat radiantly to other portions of the product. Further as shown in FIG. 10, the assembly may include a plurality of modules, the gas flow control means covering selected portion of the perforations 27 in each of the modules to direct the flow of gas into various selected portions of the inner passageway of each of the modules. In this manner, the oven assembly has great flexibility as operating as a radiant type oven, a convection type oven, or a combination of both.

While the best mode for carrying out the invention has been described in detail, those familiar with the art to which this invention relates will recognize various alternative designs and embodiments for practicing the invention as defined by the following claims.

What is claimed is:

1. A paint bake oven of a modular construction including a radiant drying module comprising: an outer insulated housing of round cross-section and an inner housing of round cross-section received within the outer housing thereof and defining a product passage; said inner housing of the drying module including solid inner and outer curved walls and a bottom wall extending therebetween defining unitary closed chambers and a central upwardly projecting supply duct and a pair of outwardly curved side passages located within each of said chambers on opposite sides of the product passage; partitions in said chambers defining a circuitous path in a manner that perfects uniform heating of said inner curved wall; a return duct communicating with the side passages of the inner housing of the drying module; and a recirculating heater mounted on said outer housing above said product passage and communicating with said supply duct for supplying heated gas to the supply duct of the drying module and receiving gas from the return duct thereof after passage through the side passages to provide radiant heating of a product passing through the product passage.

* * * * *